United States Patent [19]

Moe et al.

[11] 4,057,367

[45] Nov. 8, 1977

[54] COMBINED ROTARY-RECIPROCATING PISTON COMPRESSOR

[76] Inventors: James S. Moe, 514 W. Fireweed Lane, Anchorage, Alaska 99503; Marvin B. Carter; Ray L. Carter, both of Star Route C Box 293, Palmer, Alaska 99645

[21] Appl. No.: 639,822

[22] Filed: Dec. 11, 1975

[51] Int. Cl.[2] ..... F04B 27/06

[52] U.S. Cl. ..... 417/273

[58] Field of Search ..... 417/270–273; 418/167; 91/496

[56] References Cited

U.S. PATENT DOCUMENTS

| | | | |
|---|---|---|---|
| 726,896 | 5/1903 | Franzen | 418/167 |
| 905,861 | 12/1908 | Cuerts et al. | 417/273 |
| 935,655 | 10/1909 | Haire | 417/273 |
| 1,166,999 | 1/1916 | Loftus | 123/8.47 |
| 1,654,893 | 1/1928 | Meyers et al. | 417/273 |
| 1,658,705 | 2/1928 | Caproni | 417/273 |
| 1,772,498 | 8/1930 | Roberts | 91/496 |
| 3,710,691 | 1/1973 | Sullivan | 91/496 |

*Primary Examiner*—William L. Freeh

*Attorney, Agent, or Firm*—Strauch, Nolan, Neale, Nies & Kurz

[57] ABSTRACT

A compact but high volume displacement, relatively noiseless and vibration free compressor for refrigeration gas or the like combining a rotary drive input with six cylinders and three reciprocating pistons within a rotor housed in a stator.

11 Claims, 10 Drawing Figures

COMBINED ROTARY-RECIPROCATING PISTON COMPRESSOR

BACKGROUND OF THE INVENTION

Known refrigeration gas compressors of the type useful in household and industrial refrigeration systems are generally heavy and quite bulky in size, considering their volume and compression characteristics. Besides being inherently inefficient, reciprocating piston compressors are not only relatively heavy and bulky but also rather noisy in operation due to vibration which can be exacerbated by the required crankshaft and connecting rods. Rotary compressors overcome the noise and vibration problems to an extent, but sacrifice efficiency as a result due to large area rubbing surfaces creating heat, friction and wear during operation.

The present invention combines the more desirable characteristics of reciprocating piston compressors and rotary compressors to produce a rotary-reciprocating piston compressor of relatively simple design, low in number of moving parts and having high volume and compression characteristics with respect to weight and size of the compressor, when compared to known prior art compressors.

The very broad concept of combining rotary and reciprocating piston characteristics is known in the art of internal combustion engines, at least. Specifically, U.S. Pat. No. 1,166,999 discloses an internal combustion engine having a rotor with circumferentially arranged compression slots successively entered by compressors in the form of rollers mounted on an axis parallel to but offset from the rotor axis. A steam engine of similar design is disclosed in U.S. Pat. Ser. No. 726,896. Another engine of similar design powered by compressed gas is disclosed in U.S. Pat. Ser. No. 726,157.

However, the prior art does not disclose a rotary-reciprocating piston compressor having the characteristics of the present invention as set forth below.

SUMMARY OF THE INVENTION

It is the principal object of the invention to provide a refrigeration gas compressor or the like combining the desirable design characteristics and attendant advantages of both rotary compressors and reciprocating piston compressors.

It is another object of the invention to provide a rotary-reciprocating piston compressor having relatively high displacement and volume characteristics with respect to weight and size.

It is a further object of the invention to provide a rotary-reciprocating piston compressor having low noise and vibration characteristics.

Yet another object of the invention is to provide a rotary-reciprocating piston compressor of simple design, thus having relatively few moving parts.

Still a further object of the invention is to provide a rotary-reciprocating piston compressor which has a prolonged service life and is low in cost of manufacture.

Further novel features and other objects of this invention will become apparent from the following detailed description, discussion and the appended claims taken in conjunction with the accompanying drawings.

BRIEF DESCRIPTION OF DRAWINGS

Preferred structural embodiments of this invention are disclosed in the accompanying drawings in which.

DESCRIPTION OF THE PREFERRED EMBODIMENTS

Figure 1:
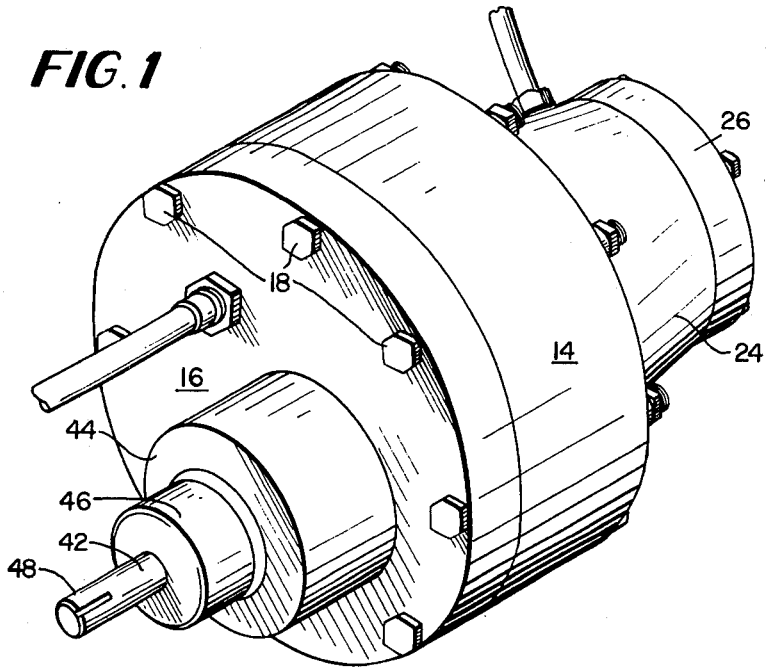
FIG. 1 is a perspective view of one embodiment of the invention.
Figure 2:
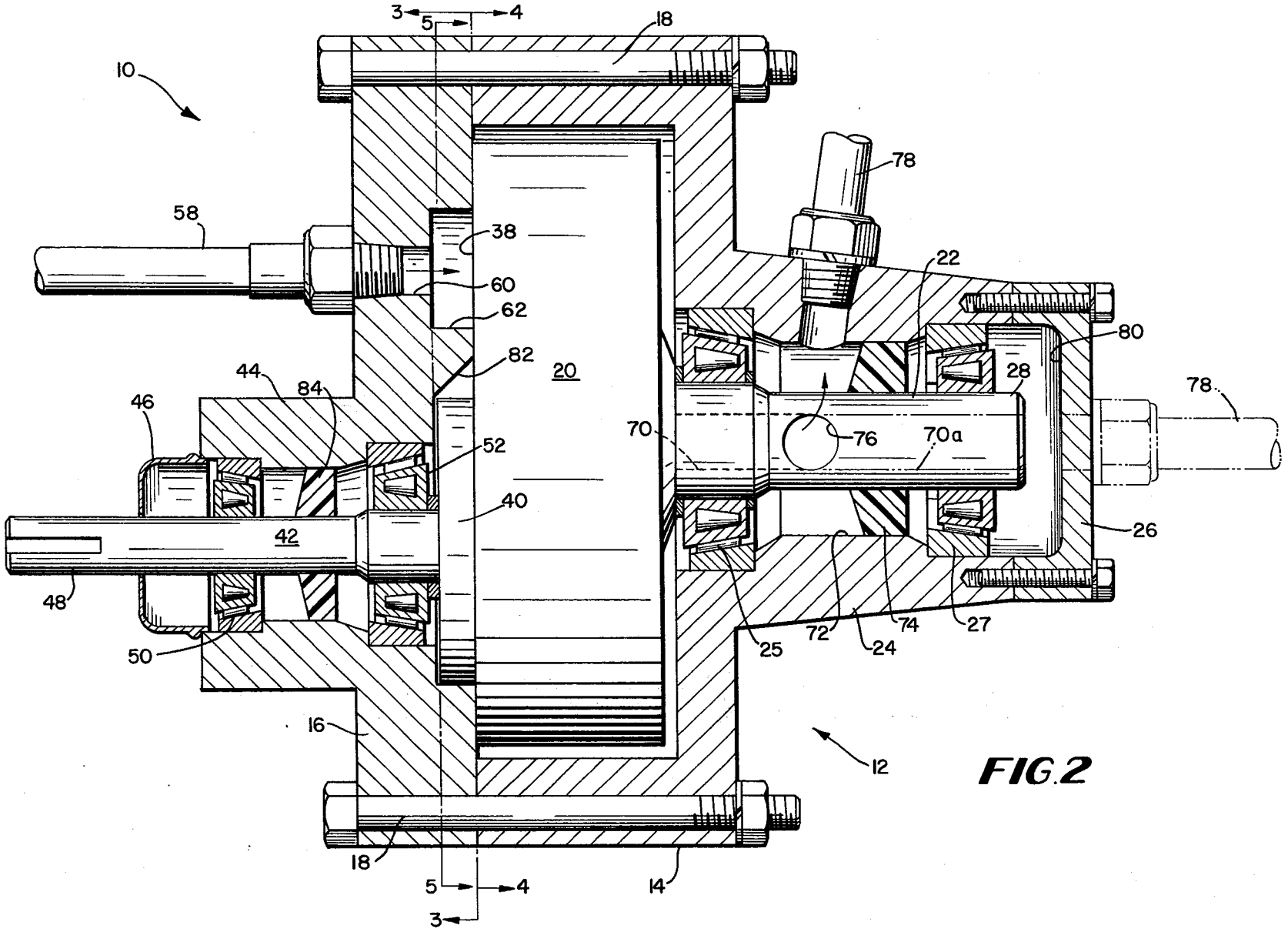
FIG. 2 is a section view taken on a longitudinal vertical plane through the compressor as shown in FIG. 1 and drawn to an enlarged scale.

Referring to Fig. 1, a compressor 10 includes a generally cylindrical housing or stator 12 having a single piece main body portion 14 and an end plate 16, bolted to body 14 by a plurality of circumferentially spaced bolt and nut assemblies 18. As shown in FIG. 2, a rotor 20 is mounted for rotation within housing 12 by provision of a rotor shaft 32 extending to the right thereof in the sense of FIG. 2. Rotor shaft 22 may be integrally formed with rotor 20. Rotor shaft 22 is arranged for rotation within extension 24 of housing main body 14 by means of tapered roller bearing assemblies 25 and 27. Housing extension 24 may be capped as shown at 26 or, in the event that rotor shaft 22 is to be the drive shaft for compressor 10, cap 26 is removed and a suitable drive connection (not shown) to a source of rotation (not shown) is provided on the now exposed free end 28 of rotor shaft 22.

Figure 4:
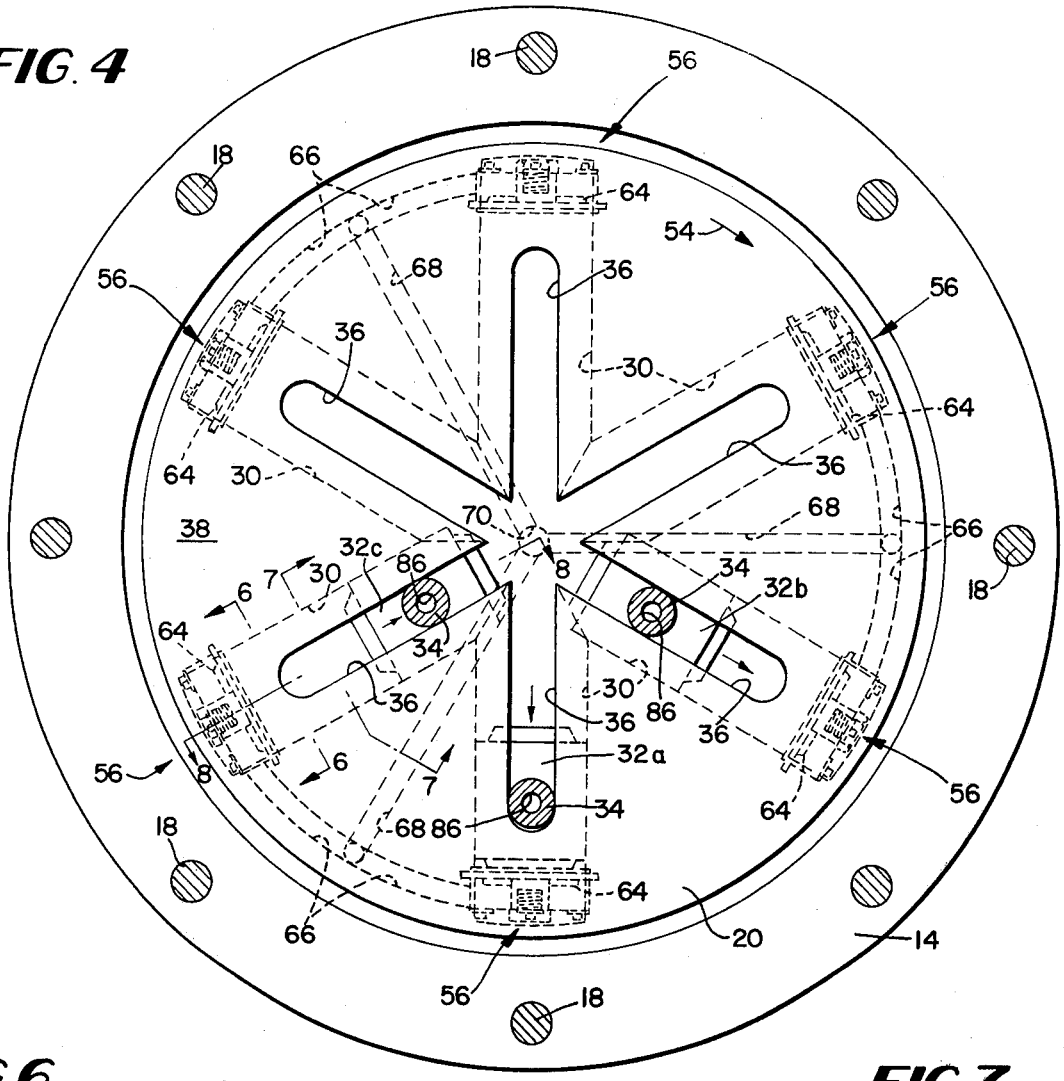
Figure 6:
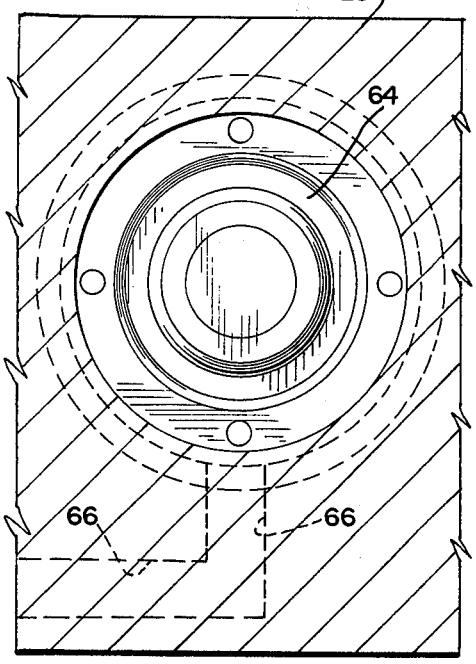
FIGS. 6, 7 and 8 are section views taken along lines 6—6, 7—7 and 8—8, respectively, of FIG. 4, each figure being drawn to a enlarged scale with respect of FIG. 4.
Figure 7:
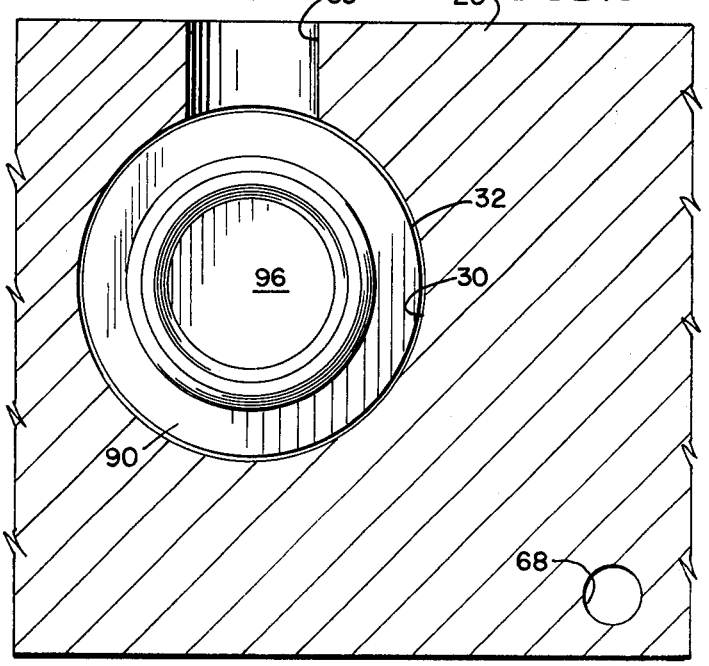

Turning now to FIG. 4, rotor 20 has six similarly internally dimensioned and equispaced gas compression chambers 30 formed therein, arranged about and intersecting the horizontal axis of rotation of rotor 20 and rotor shaft 22. Opposed pairs of chambers 30 form a single expansible chamber having a common single centerline, the expansible chambers thus being three in number. The expansible chambers thus formed have similarly externally dimensioned double action pistons 32 therein which travel the full length of the corresponding single expansible chamber formed by an opposed pair of chambers 30. Therefore, the stroke of any one piston 32 is a compression stroke in each direction of travel. Thus, the opposed faces of each piston 32 are similarly constructed compression and venting faces (as will be explained below) and each piston 32 is a double acting piston.

Figure 3:
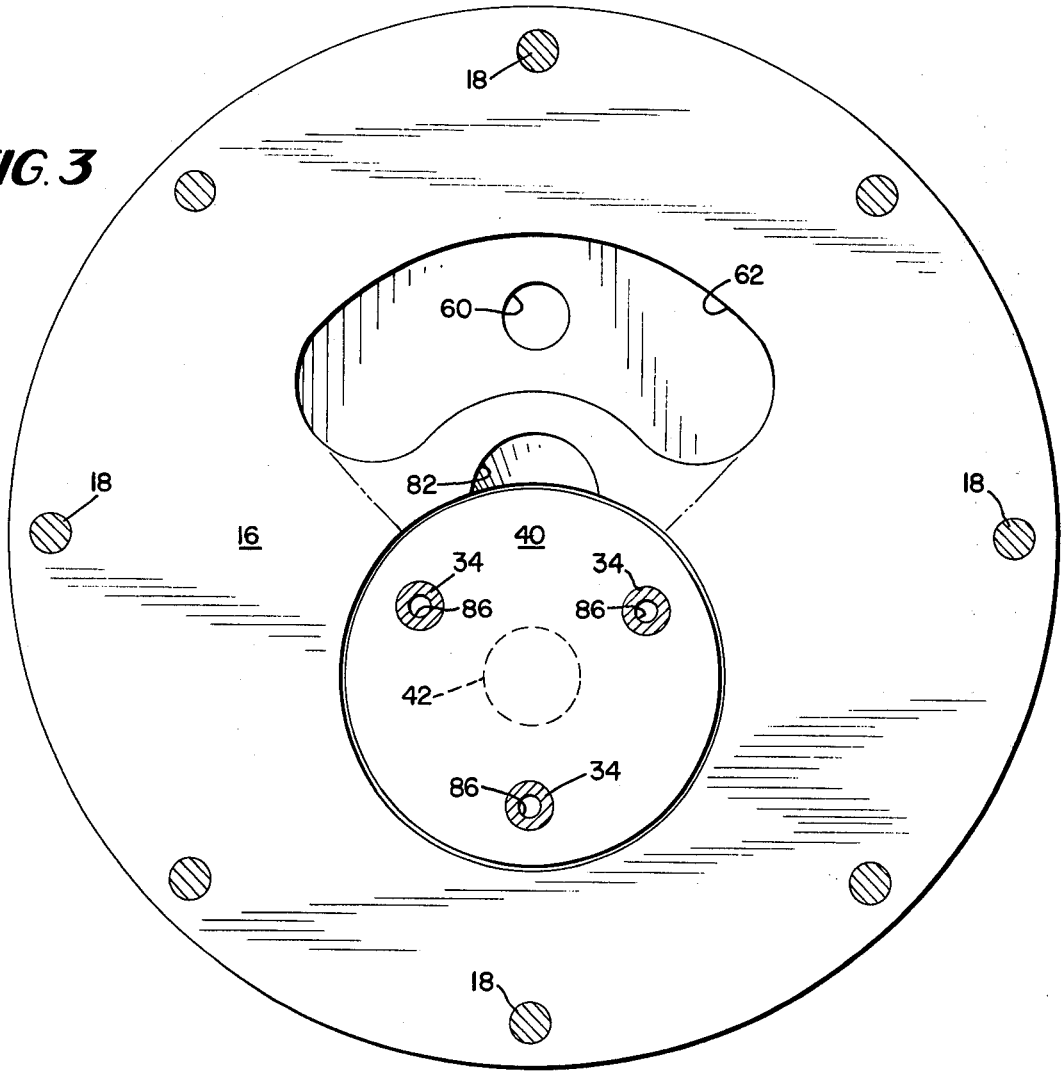
FIGS. 3, 4 and 5 are section views taken along lines 3—3, 4—4 and 5—5, respectively, of FIG. 2, FIGS. 3 and 4 being taken along the same line but in opposite directions.

Each piston 32 includes a connecting pin 34, extending from a side of rotor 20 opposite that of rotor shaft 22, the pins extending through six slots 36, one for each chamber 30, formed through the rear wall or face 38 of rotor 20. In turn, connecting pins 34 are circumferentially arranged on a circular, rotatable mounting plate 40 (FIGS. 2 and 3) which rotates within a recess 42 formed in the portion of end plate 16 adjacent rotor 20. Mounting plate 40 has a drive shaft 42 which may be formed integrally with plate 40 and extends through end plate housing 44 and cap 46 to a source of rotation (not shown) which when shaft 42 is to be the compression drive shaft, is connected to plate shaft 42 at 48. Drive shaft 42 is mounted for rotation within end plate housing 44 by a pair of tapered roller bearing assemblies 50 and 52.

Referring again to FIG. 4, the reciprocation of each piston 32 within chambers 30 across the full diameter of rotor 20 is made possible by the proper offset spacing of the axis of rotation of mounting plate 40 and its shaft 42 with respect to the axis of rotation of rotor 20 and rotor shaft 22, this spacing being equal to the radial spacing of each connecting pin 34 from the axis of rotation of mounting plate 40. Thus, during rotation of mounting plate 40, the horizontal center of each pin 34 passes through the axis of rotation of rotor 20 and rotor shaft 22. FIG. 4 illustrates the relationship of the reciprocating and rotating parts of the compressor at a point when one piston 32*a* has just reached the limit of a compression stroke. Rotor 20 is rotating in a clockwise direction as indicated by arrow 54 as, of course, are pins 34. Piston 32*b* has just travelled across the center of rotor 20 and is moving in a compression stroke towards the radially outward end 56 of its chamber 30. On the other hand, piston 32*c* has just completed a compression stroke but is about to move across the center of rotor 20 to compress gas within the opposite chamber 30. It can be seen that a very high compression/volume to compressor size ratio is acquired by the structure and relationship of three expansible chambers extending across virtually the full diameter of rotor 20, each having a piston 32 which travels the full length of its expansible chamber, and each expansible chamber being comprised of a pair of compression chambers. Thus, the high compression and efficiency characteristics of a reciprocating piston compressor are combined with the relatively low vibration and noise level characteristics of a rotary compressor.

Figure 8:
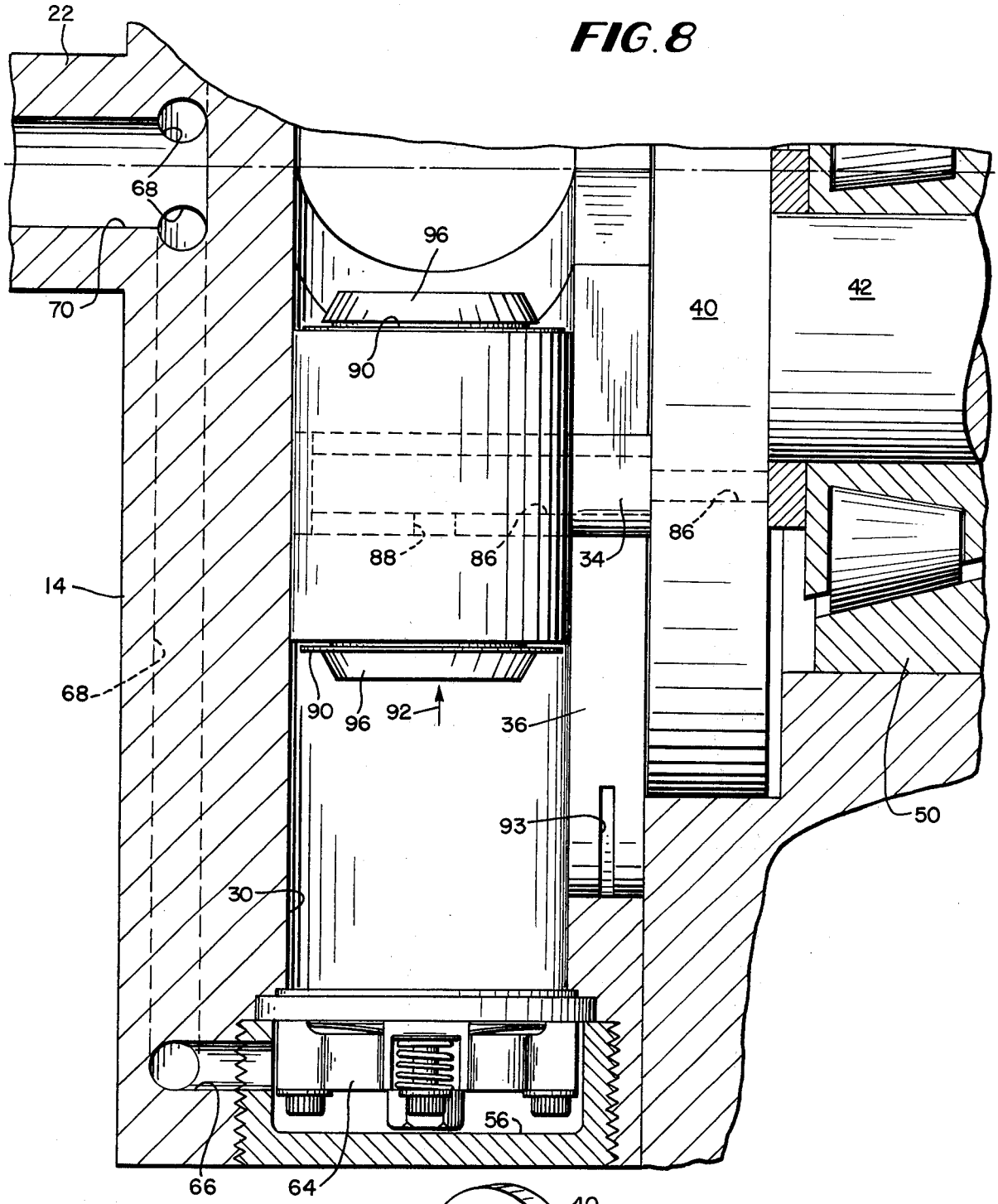

Now the conduiting of refrigerant gas through the compressor will be set forth in detail. An inlet conduit 58 (FIG. 2) is connected to a source of lubricated refrigerant gas (not shown). Conduit 58 is ported through end plate 16 at 60 to an arcuate slot 62 formed in the interior face of end plate 16, slot 62 (FIG. 5) being centered across from mounting plate 40 and extending a sufficient distance so as to be in fluid communication with three adjacent slots 36 communicating with three chambers 30 and which are free of pistons 32 so that chambers not in a compression phase may be fluid filled while gas in the remaining lower three chambers 30 is in one stage or another of compression (FIG. 4). A spring loaded circular reed valve 64 of otherwise conventional design is mounted at each outward end 56 of each chamber 30. gas being compressed within a chamber 30 by a piston 32 being forced through a reed valve 64 into a high pressure conduit 66 formed in rotor 20 to the rear of chambers 30, as illustrated in FIG. 8. As shown in dash lines in FIG. 4, adjacent pairs of conduits 66 are directed to radially inwardly arranged ducts 68 which are in fluid communication with a rotor duct 70 formed concentrically centrally within rotor shaft 22 (FIGS. 2 and 8).

As shown in FIG. 2, compressed gas is then exhausted from compressor 10 in one of two ways. In one arrangement, an annular chamber 72 is formed by housing extension 24 and generally defined between bearing 25 and a rotor shaft seal 74, arranged inwardly of bearing 27. Compressed gas exists rotor 20 at rotor shaft port 76 and is conveyed from compressor 10 by exhaust outlet 78 formed through housing extension 24 in fluid communication with annular chamber 72. In another embodiment, port 76 is eliminated and compressed gas is conveyed through an extended rotor duct 70*a*, as shown in phantom lines in FIG. 2, to an exhaust chamber 80 formed interiorly of housing cap 26. Exhaust outlet 78 would be formed through cap 26, as is also shown by phantom lines.

Figure 9:
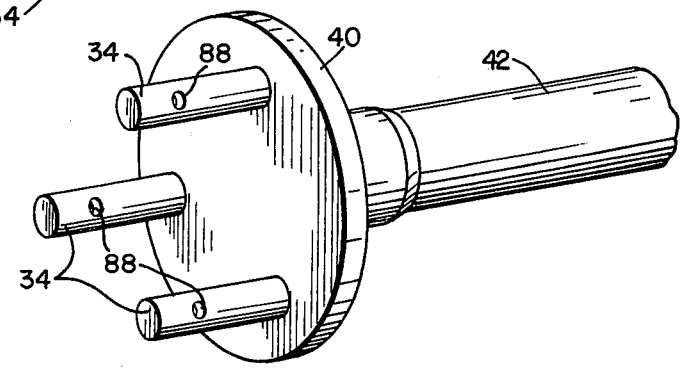
FIG. 9 is a partial perspective view of piston connecting pins and rotating plate mounting the connecting pins.
Figure 5:
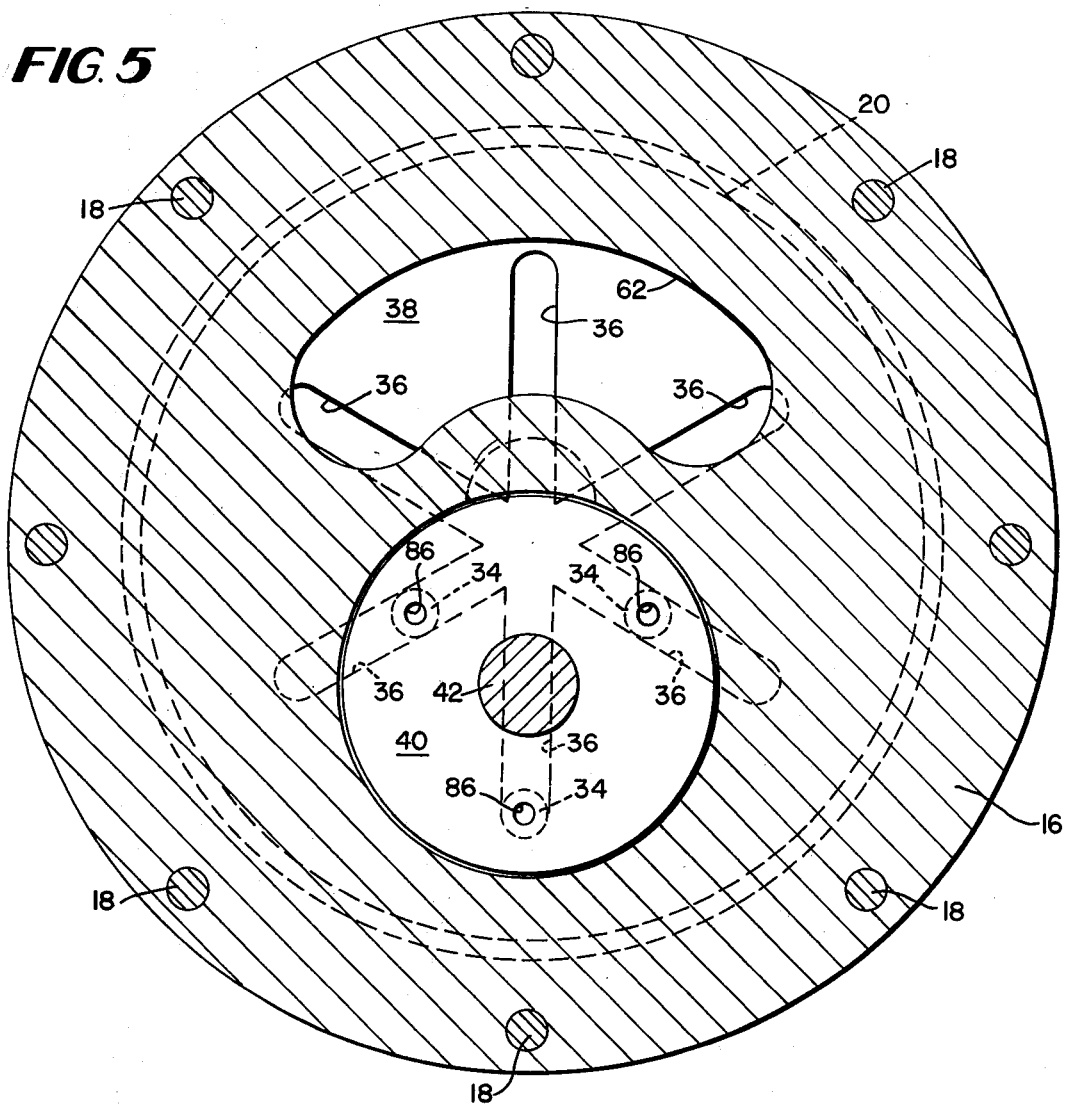

Referring now to FIGS. 2, 3, 5, 8 and 9, the venting of gas into a chamber 30 as piston 32 is leaving chamber 30 in a non-compression direction will be discussed, such venting being necessary to avoid vacuum locking of the piston within its chamber. As can be seen in FIG. 5, gas travels from arcuate slot 62 through one or more slots 36 and back via an arcuate vent 82 to the rear of mounting plate 40, between bearing 52 and plate 40. Sealing is provided by a shaft seal 84, about mounting plate drive shaft 42, as is shown in FIG. 2. Returning to FIG. 5, gas then passes from the rear of plate 40 through central bores 86 formed through plate 40, through each pin 34 and into the interior of each piston 32 through a lateral vent 88 (FIGS. 8 and 9). From the interior of each piston 32, gas passes into chamber 30 through a circular reed valve 90, shown in the open position in FIG. 8 as piston 32 is moving in a non-compression direction, indicated by arrow 92, outwardly of chamber 30. Since each piston 32 is a double acting piston, as set forth in the earlier description above, each piston is provided with a circular reed valve 90, as shown by FIG. 8. Also shown in FIG. 8 is an arcuate slot 93 formed in the outer interior face of each slot 36 for preventing gas compression therein as pin 34 bottoms thereagainst when piston 32 is in full compression.

Figure 10:
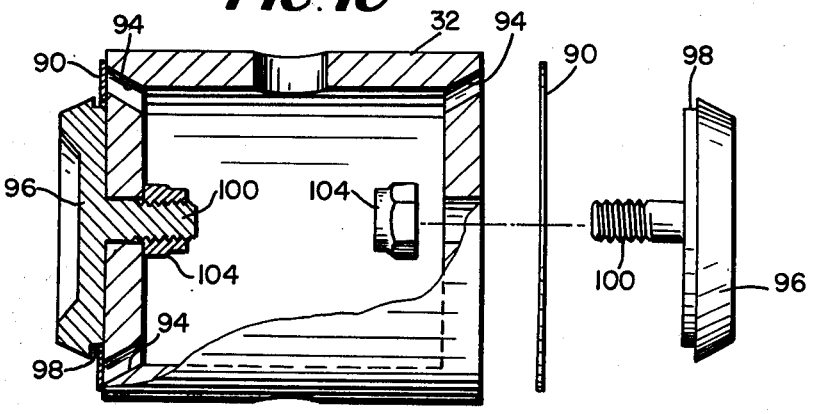
FIG. 10 is a partial longitudinal section view of one of the pistons of the compressor.

The structure of each individual piston 32 is best illustrated in FIG. 10. Each piston 32 may be formed as a hollow two-piece casting (not shown) or by any other known method. Each end face thereof includes a series of circumferentially arranged venting ports 94 located beneath reed valve 90. Each reed valve is retained in place by a retention disc 96, having sufficient clearance about the periphery thereof facing piston 32 to loosely accomodate reed valve 90, as is indicated at 98. Each disc 96 includes a central threaded stud 100 inserted through bore 102 in each face of piston 32 and retained therewithin by a nut 104.

The invention may be embodied in other specific forms without departing from the spirit or essential characteristcs thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A compressor for refrigeration gas or the like comprising: a stator housing; a rotor having an axis and being mounted for rotation about said axis within said stator housing; means defining an even numbered plurality of similarly internally dimensioned and equispaced gas compression chambers within said rotor, arranged about and intersecting said rotor axis, opposed pairs of said compression chambers forming a single expansible chamber having a single centerline, said centerline being a diameter of said rotor at a right angle to said rotor axis, a plurality of similarly externally dimensioned pistons, one in each expansible chamber; each expansible chamber piston being linearly moveable through substantially the entire length of its chamber, through said rotor axis, a plurality of connecting pins, one on each piston; rotatable plate means for mounting the free ends of said connecting pins and being disposed within said housing on one side of said rotor, the axis of rotation of said plate means being parallel to and offset a predetermined distance from said rotor axis; a first shaft extending from said plate means through said housing on the axis of rotation of said plate means; a second shaft extending from said rotor on a side thereof opposite said one axis through said housing on the axis of rotation of said rotor, one of said first or second shafts constituting a drive shaft for said compressor; sealing means about each of said shafts for sealing said rotor within said housing; means for admitting refrigeration gas to each of said expansible chambers; outlet means at the radially outward end of each of said gas compression chambers of receiving compressed gas; duct means from said outlet means through said rotor and second shaft for conveying compressed gas from said outlet means; and exhaust outlet means through said housing in fluid communication with said duct means.

2. The compressor as claimed in claim 1 wherein said first shaft constitutes said drive shaft.

3. The compressor as claimed in claim 1 wherein said outlet means comprise a spring loaded, circular reed valve assembly, operable during movement of a piston in a gas compression direction, towards said circular reed valve assembly.

4. The compressor as claimed in claim 1, said housing further comprising an annular chamber arranged about said rotor interiorly of said second shaft sealing means, said duct means including port means formed in said second shaft in fluid communication with said annular chamber, said exhaust outlet means being formed through said housing and being in fluid communication with said annular chamber.

5. The compressor as claimed in claim 1 wherein said gas compression chambers are six in number and said expansible chambers, pistons and connecting pins are each three in number.

6. The compressor as claimed in claim 5 wherein said connecting pins are equally radially spaced from the axis of rotation of said plate means, the offset distance between said rotor axis and said plate means axis being equal to the radial spacing of one of said pins from said plate means axis.

7. The compressor as claimed in claim 5 wherein each piston is a double acting piston having means defining a compression face on each end thereof.

8. The compressor as claimed in claim 7 wherein each said compression face includes a circular reed valve for venting gas therethrough when said compression face moves in a return, non-compression direction.

9. The compressor as claimed in claim 8 wherein refrigeration gas venting means are provided from said gas admitting means through said rotatable plate means and connecting pins to the interior of each piston whereby during movement of a piston within a gas compression chamber away from radially outward end, refrigeration gas is admitted to said gas compression chamber through said circular reed valve thereby preventing vacuum locking of said piston in said gas compression chamber.

10. The compressor as claimed in claim 1 wherein said duct means further comprise conduit means formed axially centrally through said second shaft.

11. The compressor as claimed in claim 10 wherein said housing further comprises means defining an exhaust chamber about an end of said second shaft opposite said rotor, said second shaft sealing means being located between said exhaust chamber and said rotor, said exhaust outlet being formed through said exhaust chamber.

* * * * *